US005534379A

United States Patent [19]

Dalal et al.

[11] Patent Number: 5,534,379

[45] Date of Patent: Jul. 9, 1996

[54] ENVIRONMENTALLY FRIENDLY TONER COMPOSITION

[75] Inventors: Edul N. Dalal, Webster; Sue E. Blaszak, Penfield; Robert L. Gruber, Pittsford; Jacques C. Bertrand, Ontario; Roger N. Ciccarelli, Rochester, all of N.Y.

[73] Assignee: Xerox Corporation, Stamford, Conn.

[21] Appl. No.: 480,376

[22] Filed: Jun. 7, 1995

Related U.S. Application Data

[63] Continuation-in-part of Ser. No. 262,170, Jun. 20, 1994, abandoned.

[51] Int. Cl.[6] ..... G03G 9/09

[52] U.S. Cl. ..... 430/106; 430/137

[58] Field of Search ..... 430/106, 110, 430/137

[56] References Cited

U.S. PATENT DOCUMENTS

| | | | |
|---|---|---|---|
| 3,590,000 | 6/1971 | Palermiti et al. | 252/62.1 |
| 3,669,922 | 6/1972 | Bartsch et al. | 260/41 |
| 3,847,604 | 11/1974 | Hagenbach et al. | 96/1 |
| 4,051,052 | 9/1977 | Ueda et al. | 252/62.1 |
| 4,298,672 | 11/1981 | Lu | 430/108 |
| 4,355,088 | 10/1982 | Westdale et al. | 430/98 |
| 4,362,803 | 12/1982 | Miyakawa et al. | 430/122 |
| 4,558,108 | 12/1985 | Alexandru et al. | 526/340 |
| 4,665,001 | 5/1987 | Fujii et al. | 430/106 |
| 4,711,832 | 12/1987 | Gruenbaum et al. | 430/106 |
| 4,935,326 | 6/1990 | Creatura et al. | 430/108 |
| 4,937,166 | 6/1990 | Creatura et al. | 430/108 |
| 4,948,686 | 8/1990 | Koch et al. | 430/45 |
| 5,166,027 | 11/1992 | Machida et al. | 430/106.6 |
| 5,262,268 | 11/1993 | Bertrand et al. | 430/137 |
| 5,292,609 | 3/1994 | Yoshikawa et al. | 430/110 |

*Primary Examiner*—John Goodrow
*Attorney, Agent, or Firm*—Oliff & Berridge; Eugene Palazzo

[57] ABSTRACT

Toner compositions are formed by selecting a portion of at least one metal-containing pigment or dye and a portion of at least one metal-free pigment or dye, at least one pigment or dye containing a regulated metal and/or material and at least one pigment or dye containing a non-regulated metal and/or material, at least two pigments or dye each containing a different regulated metal and/or material, or pigments or dyes which contain different regulated metals and/or materials in different concentrations to provide required toner properties while maintaining metal, regulated metal and/or regulated material content of a toner composition below a prescribed level, and dispersing the pigments together in the composition.

19 Claims, No Drawings

ENVIRONMENTALLY FRIENDLY TONER COMPOSITION

This is a Continuation-in-Part of application No. 08/262,170, filed Jun. 20, 1994, now abandoned.

FIELD OF THE INVENTION

This invention relates to a method of forming a toner composition and to color toner formulations. Specifically, the present invention relates to a method of forming a toner to provide developer properties while maintaining regulated and hazardous materials content of the toner below a prescribed level.

BACKGROUND

Toner compositions with color pigments are known. For example, U.S. Pat. No. 4,948,686 discloses processes for the formation of two color images with a color developer comprised of a first toner comprised of certain resin particles, such as styrene butadyene, and a first pigment such as copper phthalocyanine.

Toners with metal-containing pigments have difficulty meeting strict regulations that are prescribed for disposal of hazardous materials. Jurisdictions such as California impose strict regulations on the disposal of metal-containing materials. The regulations apply to xerographic toners.

It is desirable to lower the amount of metal in toners to meet hazardous disposal standards. However, lowering metal content can adversely affect properties of the toners such as light fastness, electrical properties and bleed resistance. Meeting hazardous disposal standards is particularly a problem with compositions that provide blue, cyan, red, magenta and green colorations for high performance xerographic toners.

The present invention provides a toner composition having a lower total amount of toxic metal content. The composition is characterized by excellent electrical properties for use as a high performance xerographic toner. The composition of the invention has excellent light fastness, electrical properties and bleed resistance. The properties by the present toner compositions are favorably comparable to properties for similar toner compositions which contain toxic materials, but the present toner compositions are substantially reduced in toxic material content.

U.S. Pat. No. 4,051,052 to Ueda et al. discloses various types of dyes or pigments that are used in liquid developers.

U.S. Pat. No. 3,669,922 to Bartsch et al., U.S. Pat. No. 4,655,001 to Fujii et al., U.S. Pat. No. 4,711,832 to Gruenbaum, et al., U.S. Pat. No. 4,948,686 to Koch et al. and U.S. Pat. No. 5,166,027 to Machida et al. disclose toners containing combinations of pigments.

Fujii et al., U.S. Pat. No. 4,665,001 relates to toner compositions wherein one preferred embodiment comprises a halogen-substituted copper phthalocyanine pigment and an indanthrone pigment used as a combination.

SUMMARY OF THE INVENTION

The present invention is directed to a method of forming a toner composition and to a toner composition having a combination of pigments that meets hazardous disposal standards and that has adequate lightfastness, electrical properties and bleed resistance.

The present invention is directed to a toner composition comprising at least one pigment containing a regulated material and at least one pigment containing a non-regulated material, at least two pigments each containing a different regulated material, or pigments which contain different regulated materials in different amounts dispersed together in a proportion to provide a toner with desired developer properties and a metal content below a prescribed level.

The present invention is also directed to a method of forming a toner composition comprising selecting a portion of at least one metal-containing pigment and a portion of at least one metal-free pigment, at least one pigment containing a regulated metal and at least one pigment containing a non-regulated metal, at least two pigments each containing a different regulated metal below its regulated threshold, or pigments which contain different regulated metals in different amounts to provide developer properties while maintaining the metal content of a toner composition comprising the pigments below a prescribed level and dispersing the two or more pigments together in the toner composition.

DESCRIPTION OF PREFERRED EMBODIMENTS

The invention relates to toner compositions comprising at least one metal-containing pigment or dye and at least one metal-free pigment or dye, or at least one pigment or dye containing a regulated metal and at least one pigment or dye containing a non-regulated metal, at least two pigments or dyes each containing a different regulated metal below its regulated threshold or pigments or dyes which contain materials which are regulated for other reasons, such as hazardous impurities. In this context, "regulated" materials are those which are limited by certain laws to specified maximum thresholds because of their real or perceived hazardous nature such as, for example, certain dyes, solvents, binders.

The present toner composition offers high quality color, color gamut, lightfastness, electrical and bleed resistance properties while remaining environmentally safe.

The toner composition of the present invention may include binder resins, pigments, dyes, charge control agents, lubricating waxes, and/or conducting agents.

Illustrative examples of suitable binder resins selected for the toner composition of the present invention include polyamides, polyolefins, styrene acrylates, styrene methacrylates, styrene butadyenes, crosslinked styrene polymers, epoxies, polyurethanes, vinyl resins, including homopolymers or copolymers of two or more vinyl monomers. Suitable vinyl monomers for forming polymers include styrene, p-chlorostyrene, saturated monoolefins such as ethylene, propylene, butylene, isobutylene and the like; unsaturated monoolefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate and butyl methacrylate; acrylonitrile, methacrylonitrile, acrylamide, styrene butadyene copolymers and mixtures thereof. In addition, crosslinked resins including polymers, copolymers, and homopolymers of the aforementioned polymers may be selected.

Further examples of specific binder resins are the esterification products of a dicarboxylic acid and a diol comprising a diphenol. These resins are illustrated in U.S. Pat. No. 3,590,000, the entire disclosure of which is hereby incorporated herein by reference. Other resins include polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol, and pentaerythritol; styrene acrylates and mixtures thereof. The low melt resins (described in U.S. Pat. No. 3,590,000) contain high density microgel particles. Other specific toner resins include styrene/methacrylate copolymers and styrene/butadyene copolymers; Pliolites; and suspension polymerized styrene butadyenes as described in U.S. Pat. No. 4,558,108, the entire disclosure of which is hereby incorporated herein by reference.

Generally, the resin content of the toner composition comprises from about 70% to about 95% by weight of the composition, preferably from about 85% to about 92% by weight of the composition.

Various suitable pigments can be employed in toners of the invention. Numerous suitable pigments by name and Pigment Color Index number are listed in the following Table 1.

TABLE 1

| Pigment Name | Pigment or dye Type | Color Index Number | Metals |
|---|---|---|---|
| Chrome Black | Solvent Black 35 | 12195 | Chromium |
| Carbon Black | Pigment Black 7 | 77266 | no |
| Fanal Blue | Pigment Blue 1 | 42595:2 | Molybdenum |
| Pthalocyanine Blue | Pigment Blue 15:3 | 74160 | Copper |
| Metal Free Phthalocyanine | Pigment Blue 16 | 74100 | no |
| Paliogen Blue | Pigment Blue 60 | 69800 | no |
| Alkali Blue | Pigment Blue 61 | 42765:1 | no |
| Phthalocyanine Green | Pigment Green 36 | 74265 | Copper |
| Phthalocyanine Green YS | Pigment Green 7 | 74260 | Copper |
| Malachite Green | Basic Green 4 | 42000 | no |
| Clarion Red | Pigment Orange 46 | 15602 | Barium |
| DNA Orange | Pigment Orange 5 | 12075 | no |
| Naphthol Red | Pigment Red 17 | 12390 | no |
| Pyrazolone Red | Pigment Red 38 | 21120 | no |
| Red Lake C | Pigment Red 53:1 | 15585:1 | Barium |
| Rhodamine SM | Pigment Red 81:3 | 45160:3 | Molybdenum |
| Fast Red | Pigment Red 112 | 12370 | no |
| Quinacridone | Pigment Red 122 | 73915 | no |
| Paliogen Red | Pigment Red 123 | 71145 | no |
| Rhodamine CF | Pigment Red 169 | 45160:2 | Copper |
| Lithol Red | Pigment Red 48:3 | 15865:3 | Strontium |
| Barium Lithol | Pigment Red 49:1 | 15630:1 | Barium |
| Calcium Lithol | Pigment Red 49:2 | 15630:2 | yes calcium |
| Diarylide Yellow | Pigment Yellow 17 | 21105 | no |
| Permanent Yellow FGL | Pigment Yellow 97 | 11767 | no |
| Lead Chromate Yellow | Pigment Yellow 34 | 77603 | Lead, Chromium |
| Carbazole Violet | Pigment Violet 23 | 51319 | no |
| Quinacridone Violet | Pigment Violet 19 | 73900 | no |
| Methyl Violet | Pigment Violet 27 | 42535:3 | Copper |
| Methyl Violet PM Lake | Pigment Violet 3 | 42535:2 | Molybdenum |

illustrative examples of cyan materials that can be used as pigments include copper tetra-4-(octadecyl sulfonamido) phthalocyanine, copper phthalocyanine pigment listed in the Color Index as CI 74160, CI Pigment Blue, and Anthracene Blue, identified in the Color Index as CI 69810, Special Blue X-2137, and the like. Illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow, 33, 2,5-dimethoxy- 4-sulfonanilide, phenylazo-r'-chloro-2,5-dimethoxy acetoacetanilide and Permanent Yellow FGL. The aforementioned pigments may be incorporated into the toner composition in various suitable effective amounts.

The toner composition of the invention is formed by selecting a portion of at least one pigment comprising regulated material and a portion of at least one pigment without regulated material. Pigments (or dyes) which contain regulated materials are readily determined by one of ordinary skill in the art. The portions are selected to provide developer properties while maintaining the regulated material content of the toner composition below a prescribed level. The prescribed level may be determined according to a hazardous waste disposal standard. After the portions of the pigment comprising regulated material and the pigment without regulated material are selected, the pigments are dispersed in the toner composition according to the selected portions.

While the prescribed level usually is determined according to a hazardous waste disposal standard, the prescribed level may be determined according to any required set level of regulated material content for toner compositions. The proportion of portions of pigment comprising regulated material to pigment without regulated material can be between 1/10 and 10/1 pigment comprising regulated material pigment without regulated material. A preferred proportion is between 2/1 and 1/2 pigment comprising regulated material pigment without regulated material. The proportion of pigment comprising regulated material to pigment without regulated material will vary from at least some pigment comprising regulated material to a maximum proportion determined by the total weight percent of pigment in the toner composition according to the prescribed level.

While the discussion above is focused upon pigmented toner compositions, the description is equally applicable to toner compositions containing a mixture of pigments and dyes or dyes alone as the colorant. Suitable dyes for use in the toner compositions of the present invention are well-known dyes such as, for example, anthraquinones, monoazo dyes, diazo dyes, phthalocyanines. aza[18]annulenes, and formazan copper complexes, triphenodioxazines. Specific examples include, but are not limited to, Carodirect Turquoise FBL Supra Conc. (Direct Blue 199). available from Carolina Color and Chemical; Special Fast Turquoise 8GL Liquid (Direct Blue 86), available from Mobay Chemical; Thermoplast Blue dye; Drimarene Brilliant Red X-2B (Reactive Red 56), available from Pylam, Inc.; Levafix Brilliant Red E-4B, available from Mobay Chemical; Procion Red H8B (Reactive Red 31), available from ICI America; Carodirect Yellow RL (Direct Yellow 86), available from Carolina Color and Chemical; Cartasol Yellow GTF Liquid Special 110, available from Sandoz, Inc.; D&C Yellow # 10 (Acid Yellow 3), available from Tricon; Yellow Shade 16948, available from Tricon, Basacid Black X34, available from BASF, Carta Black 2GT, available from Sandoz, Inc.; Levanol Brilliant Red 3BW (Mobay Chemical Company); Levaderm Lemon Yellow (Mobay Chemical Company); Sirius Supra Yellow GD 167; Cartasol Brilliant Yellow 4GF (Sandoz); Pergasol Yellow CGP (Ciba-Geigy); Pyrazol Black BG (ICI); Morfast Black Conc A (Morton-Thiokol); Diazol Black RN Quad (ICI); Luxol Blue MBSN (Morton-Thiokol); Sevron Blue 5GMF (ICI); Basacid Blue 750 (BASF); Bernacid Red, available from Berncolors, Poughkeepsie, N.Y.; Pontamine Brilliant Bond Blue; Telon Fast Yellow 4GL-175; BASF Basacid Black SE 0228; the Pro-Jet series of dyes available from ICI, including Pro-Jet Yellow I (Direct Yellow 86), Pro-Jet Magenta I(Acid Red 249), Pro-Jet Cyan I (Direct Blue 199), Pro-Jet Black I (Direct Black 168), Pro-Jet Yellow 1-G (Direct Yellow 132), Aminyl Brilliant Red F-B, available from Sumitomo Chemical Co. (Japan), the Duasyn line of "salt-free" dyes available from Hoechst, such as Duasyn Direct Black HEF-SF (Direct Black 168), Duasyn Black RL-SF (Reactive Black 31), Duasyn Direct Yellow 6G-SF VP216 (Direct Yellow 157), Duasyn Acid Yellow XX-SF VP413 (Acid Yellow 23), Duasyn Brilliant Red F3B-SF VP218 (Reactive Red 180), Duasyn Rhodamine B-SF VP353 (Acid Red 52), Duasyn Acid Blue AE-SF VP344 (Acid Blue 9), and the like, as well as mixtures thereof.

The pigment or dyes may be present in the toner composition in amounts ranging from 1 to 25%, preferably 5 to 20% by weight of the toner composition.

The term color target, as employed in the subject application, refers to a particular predetermined color provided by a toner on a substrate vis-a-vis imaging processes. Each predetermined color target is defined in terms of CIE parameters, which are well-known. For example, each predetermined color target possesses particular lightness, chroma and hue. These predetermined color targets enable the duplication of a particular color target even when utilizing various pigments and dyes in toners. The predetermined color targets apply to spot colors, such as 4850 Red, and also to process colors, e.g., cyan, magenta, yellow, etc. As used in the present application, the term color requirement is used interchangeably with color target. Spot colors refer to single colors alone, while process colors refer to mixtures of up to four primary colors in various desired percentages.

The term color strength, as used in the present application, is defined as the quantity of a colorant (pigment or dye) that is required to obtain a particular color target. Color strengths typically vary from pigment to pigment and dye to dye and, thus, the colorants are used in various quantities in the toner.

The term regulated materials, as used in the present application, refers to hazardous materials which are limited by various laws and statutes in numerous states and countries. For example, certain persistent/bioaccumulative metals, such as copper, mercury, barium and chromium are materials which are presently regulated around the world. Additionally, carcinogenic impurities, such as benzidine, materials which cause fish aquatic toxicity and flash point/flammability levels to rise above certain levels are impermissible.

For example, copper phthalocyanine (CuPC) (Pigment Blue 15:3) is used as a cyan pigment for many xerographic toners. This pigment has several desirable properties including excellent chroma, high color strength, good processability, etc. However, recent environmental regulations in California and other states, limiting maximum concentrations of several materials, could make these toners unacceptable because of their copper content. One solution to this problem is to switch to a metal-free phthalocyanine (MFPC). Such pigments are available, but they have several drawbacks relative to CuPC, including lower chroma (duller color), lower color strength (more pigment is required) and much higher cost (about three and one half times that of CuPC).

The following Table compares the properties of CuPC and MFPC. The chroma data provided were obtained from paint tinting experiments. Pigment color characteristics obtained from paint tinting experiments are known to correlate with those from toner images. Note that the CuPC is higher chroma (brighter color) and lower cost that MFPC.

TABLE 2

| | CuPC (Pig. Blue 15.3) | MFPC (Pig. Blue 16) |
|---|---|---|
| Chroma at 1% pigment | 43.5 | 41.2 |
| Chroma at 5% pigment | 51.6 | 44.8 |
| Chroma at 3% pigment | 53.5 | 43.6 |
| Chroma at 7% pigment | 54.4 | 41.7 |
| Cost | ~$10/lb | ~$35/lb |
| Copper content | 10.5 wt. % | 0 wt. % |

Other pigments for particular colors have a wide range of chroma and cost and, thus, must be selected accordingly.

The maximum proportion of metal-containing pigment or dye/metal-free pigment or dye can be determined by the following relationship (1):

$$X=S_1/100M \quad (1)$$

wherein X=% metal-containing pigment or dye in the toner; $S_1$=the maximum parts per million (ppm) permitted by a hazardous waste standard; and M=% metal content of the metal-containing pigment or dye.

A method of forming a toner composition comprises determining a permissible percentage of metal-containing pigment or dye in a toner composition according to (1) followed by the step of determining a percentage of metal-free pigment or dye in the toner composition according to the relationship (2):

$$Y=(S_2-X)K \quad (2)$$

where $S_2$=a percent pigment or dye required in a toner composition to provide coloration as established by a color requirement and Y=a percent of metal-free pigment required to be added to the toner to meet requirement $S_2$. K is the ratio of the Color Strength of the metal-containing pigment or dye to that of the metal-free pigment or dye.

Similarly, a toner composition having a predetermined amount of regulated material may be determined by the following method. The maximum proportion of pigment or dye comprising regulated material pigment or dye without regulated material can be determined by the following relationship (1):

$$X=S_1/100M \quad (1)$$

wherein X=% pigment or dye comprising regulated material in the toner; $S_1$=the maximum parts per million (ppm) permitted by a hazardous waste standard; and M=the % metal content of the pigment or dye comprising regulated material.

A method of forming a toner composition comprises determining a permissible percentage of pigment or dye comprising regulated material in a toner composition according to (1) followed by the step of determining a percentage of pigment or dye without regulated material in the toner composition according to the relationship (2):

$$Y=(S_2-X)K \quad (2)$$

where $S_2$=a percent pigment or dye required in a toner composition to provide coloration as established by a color requirement and Y=a percent of pigment or dye without regulated material required to be added to the toner to meet requirement $S_2$. K is the ratio of the Color Strength of the pigment or dye comprising regulated material to that of the pigment or dye without regulated material.

Fujii et al., U.S. Pat. No. 4,665,001 relates to toner compositions wherein one preferred embodiment comprises a halogen-substituted copper phthalocyanine pigment and an indanthrone pigment used as a combination. A sharp blue color is obtained by mingling of a navy blue of the indanthrone pigment and the green color of the halogen-substituted copper phthalocyanine pigment. Additionally, the negative chargeability of the indanthrone pigment and the relatively neutral chargeability of the halogen-substituted copper phthalocyanine results in a shifting of the polarity of the entire pigment to the negative side.

The method of the present invention can be advantageously applied to formulate Fujii et al. type compositions that meet prescribed hazardous waste disposal formulations. For example, a percentage of pigment containing regulated material/metal can be determined according to (1) and a percent pigment without regulated/metal can be determined according to (2) wherein $S_2$ is a percent pigment required for a sharp blue color or $S_2$ may be determined by a required negative polarity.

Additional components of the toner may be added to the resin prior to mixing the resin with the pigment or dye. Alternatively, these components may be added after the resin and the pigment have been mixed but prior to extrusion. Some of the additional components may be added after extrusion, such as charge control additives, particularly when the pigmented toner is to be used in a liquid developer. These components include but are not limited to stabilizers, waxes, and charge control additives.

Various known suitable effective charge control additives can be incorporated into the toner compositions of the present invention such as quaternary ammonium compounds and alkyl pyridinium compounds, including cetyl pyridinium halides and cetyl pyridinium tetrafluoroborates, as disclosed in U.S. Pat. No. 4,298,672, the disclosure of which is totally incorporated herein by reference, and distearyl dimethyl ammonium methyl sulfate, and the like. Particularly preferred as a charge control agent is cetyl pyridinium chloride. The charge enhancing additives are usually present in the final toner composition in an amount of from about 1 percent by weight to about 20 percent by weight.

Other additives may also be present in toners obtained by the process of the present invention. External additives may be applied, for example, in instances such as when toner flow is to be assisted, or when lubrication is needed to assist a function such as cleaning of the photoreceptor. The amounts of external additives are measured in terms of percentage by weight of the toner composition, but are not themselves included when calculating the percentage composition of the toner. For example, a toner composition containing a resin, a pigment, and an external additive may comprise 80 percent by weight resin and 20 percent by weight pigment; the amount of external additive present is reported in terms of its percent by weight of the combined resin and pigment.

External additives may include any additives suitable for use in electrostatographic toners, including fumed silica, silicon derivatives such as Aerosil R972, available from Degussa, Inc., ferric oxide, hydroxy terminated polyethylenes such as Unilin, polyolefin waxes, which preferably are low molecular weight materials, including those with a molecular weight of from about 1,000 to about 20,000, and including polyethylenes and polypropylenes, polymethylmethacrylate, zinc stearate, chromium oxide, aluminum oxide, titanium oxide, stearic acid, polyvinylidene fluorides such as Kynar, and other known or suitable additives. External additives may be present in any amount, provided that the objectives of the present invention are achieved, and preferably are present in amounts of from about 0.1 to about 1 percent by weight. These additives can be introduced into the resin prior to mixing with pigments.

The pigments or dyes, the resin and any or all additives may be mixed together, preferably in a high energy mixing device such as a Loedige Blender. The pigments, resin and additives are first mixed in the blender with low plow speed, usually at about 200 rpm to about 600 rpm. After several minutes, for example, about 2 to about 6 minutes, the speed of the blender or mixer is increased and the chopper blades are turned on, at about, for example, 3400 rpm for 1 minute to thoroughly mix the pigments, resin, and additives, and to chop up the wet cake. The pigments may still dry out to some extent, but at room temperature, the agglomeration is expected to be minimal.

After the toner ingredients have been mixed, they are further blended, preferably in an extruder. Generally, any extruder, such as a single or twin screw extruder, suitable for preparing electrophotographic toners, may be employed.

The resulting toners optionally can be formulated into a developer composition by mixing with carrier particles. Illustrative examples of carrier particles that can be selected for mixing with the toner composition prepared in accordance with the present invention include those particles that are capable of tribroelectrically obtaining a charge of opposite polarity to the charge of the toner particles. Accordingly in one embodiment, carrier particles may be selected so as to be of opposite polarity in order that the toner particles when negatively charged will adhere to and surround the carrier particles.

Illustrative examples of such carrier particles include granular zircon, granular silicon, glass, steel, nickel, iron ferrites, silicon dioxide, and the like. Additionally there can be selected as carrier particles, nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated hereby by reference.

The selected carrier particles can be used with or without a coating. The coating is generally comprised of fluoropolymers, such as polyvinylidene fluoride resins, terpolymers of styrene, methyl methacrylate, a silane, such as triethoxy silane, tetrafluorethylenes, other known coatings and the like.

The diameter of the carrier particles is generally from about 50 microns to about 1,000 microns, preferably about 200 microns, thus allowing these particles to possess sufficient density and inertia to avoid adherence to the electrostatic images during the development process. The carrier particles can be mixed with the toner particles in various suitable combinations. However, best results are obtained when about 1 part toner to about 10 parts to about 200 parts by weight of carrier are mixed.

Toners of the invention can be used in known electrostatographic imaging methods. Thus for example, the toners or developers of the invention can be charged, e.g., triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll at a temperature lower than 200° C., preferably lower than 160° C., more preferably lower than 140° C. and more preferably about 110° C.

The invention will further be illustrated in the following, non-limiting examples, it being understood that these examples are intended to be illustrative only and that the invention is not intended to be limited to the materials, conditions, process parameters and the like recited therein.

EXAMPLE 1

A cyan toner composition is prepared by melt blending. The toner composition contains BASF (20. Heliogen Blue K7090 (Pigment Blue 15:3) with BASF Co. Heliogen Blue D-7560 (Pigment Blue 16). BASF Co. Heliogen Blue K7090 (Pigment Blue 15:3) has a theoretical copper content of 11.03%. California hazardous waste laws permit disposal of materials having a maximum limit for copper of 2500 ppm. The amount of copper metal in a cyan toner in parts per million (ppm) is equal to (100)×(% metal in pigment)×(% pigment in the toner). The maximum percent pigment permitted by law to provide a maximum limit of copper of 2500 ppm is equal to (100)×(11.03)×(% pigment in the toner). The maximum percentage of the copper containing Heliogen Blue K7090 permitted in the toner is equal to 2.27%.

EXAMPLE 2

In this example, the cyan toner is compounded to meet a color target percent of pigment of 3.30% to provide light fastness, electrical and bleed resistance properties. Since the maximum percent of pigment in the toner provided by the Heliogen Blue K7090 copper containing pigment is 2.27, the composition is compounded with 2.27% Heliogen Blue K7090 and 1.03% metal-free phthalocyanine BASF Co. Heliogen Blue D-7560 (Pigment Blue 16).

EXAMPLES 3–9

In each of the following examples, a toner was compounded to meet both a color target percent of pigment and to meet a prescribed level of metal content according to a hazardous waste law requirement. The percentage of metal-containing pigment in the toner composition was determined by the relationship (1)

$$X=S_1/100M \quad (1)$$

wherein X=% metal-containing pigment in the toner; $S_1$=the maximum parts per million (ppm) permitted by a hazardous waste standard; and M=the percentage metal content of the metal-containing pigment.

Additionally in each of the examples as shown in the Table, a percentage of metal-free pigment was determined to be added to the toner composition to provide a total percent of pigment as established by a color requirement. The amount of metal-free pigment required to be added to the toner was determined by the relationship (2):

$$Y=(S_2-X)K \quad (2)$$

wherein $S_2$=a percent pigment required in the toner composition to provide coloration as established by a color requirement and Y=a percent of metal-free pigment required to be added to the toner components to meet the requirement $S_2$. K is the ratio of the Color Strength of the metal-containing pigment to that of the metal-free pigment. The results are provided in the following Table 3 where for simplicity we have assumed that the two pigments in each example have equal Color Strengths (i.e., K=1):

TABLE 3

| Example | Metal Containing Pigment | Metal Content (m) (%) | Metal-Free Pigment | Prescribed Maximum Metal Level (PPM) ($S_1$) | Color Target (%) ($S_2$) | Percent Metal-Containing Pigment | Percent Metal-Free Pigment |
|---|---|---|---|---|---|---|---|
| 3 | BASF Heliogen Blue K7090 | 11.03 | BASF Sudan Blue 670 dye | 2500 | 3.30 | 2.27 | 1.03 |
| 4 | BASF Fanal Pink D4830 | 29.70 | BASF Basonyl/Red 560 dye | 3500 | 3.0 | 1.18 | 1.82 |
| 5 | BASF Fanal Pink D4830 | 29.70 | Hostaperm Pink EB pigment red 122 | 3500 | 3.0 | 1.18 | 1.82 |
| 6 | BASF Lithol Scarlet D3700 | 25.32 | BASF Sudan red 380 dye | 10,000 | 7.0 | 3.95 | 3.05 |
| 7 | BASF Lithol Scarlet D3700 | 25.32 | BASF Paliogen red L3870HD pigment red 123 | 10,000 | 7.0 | 3.95 | 3.05 |
| 8 | BASF Heliogen Blue K7090 | 11.03 | BASF Thermoplast Blue 684 solvent violet 13 | 2500 | 7.0 | 2.27 | 4.73 |
| 9 | BASF Heliogen Blue K7090 | 11.03 | BASF Paliogen Blue L6482 pigment blue 60 | 2500 | 7.0 | 2.27 | 4.73 |

While the invention has been described with reference to particular preferred embodiments, the invention is not limited to the specific examples given, and other embodiments and modifications can be made by those skilled in the art without departing from the spirit and scope of the invention.

What is claimed is:

1. A method of forming a toner composition containing a predetermined metal content, comprising:

(a) determining a first target percentage of at least one pigment or dye containing metal in a toner composition according to a prescribed level of metal content in said toner;

(b) determining a second target percentage of at least one metal-free pigment or dye in said toner required to provide sufficient coloration without allowing a percentage of said at least one pigment or dye containing metal to exceed said first target percentage; and (c) dispersing said at least one pigment or dye containing metal and said at least one metal-free pigment or dye together in a toner composition.

2. The method of claim 1, wherein said prescribed level is prescribed by a hazardous waste disposal standard.

3. The method of claim 1, wherein said pigments are dispersed together with a binder resin.

4. The method of claim 3, wherein said binder resin is a polyester resin obtained from the reaction of bisphenol A and propylene oxide, followed by the reaction of the resulting product with fumaric acid.

5. The method of claim 1, wherein said pigments are dispersed together with a lubricating wax.

6. The method of claim 1, wherein said pigments or dyes are contained in an amount of from about 1% by weight to about 25% by weight of said toner composition.

7. The method of claim 1, wherein said first target percentage of said at least one pigment or dye containing metal is determined by the relationship (1):

$$X=S_1/100M \quad (1)$$

wherein X is said first target percentage of at least one pigment or dye containing metal in the toner; $S_1$ is the maximum parts per million (ppm) of metal permitted by a hazardous waste standard; and M is a metal content percentage of said at least one pigment or dye containing metal.

8. The method of claim 7, wherein said second target percentage of said at least one metal-free pigment or dye is determined by the relationship (2):

$$Y=(S_2-X)K \quad (2)$$

wherein $S_2$ is a percentage of pigment or dye required in the toner composition to provide coloration as established by a color requirement, Y is a percentage of said at least one metal-free pigment or dye required to be added to the toner components to meet the requirement $S_2$, and K is the ratio of the color strength of the at least one pigment or dye containing metal to the color strength of the at least one metal-free pigment or dye.

9. The method according to claim 1, wherein said at least one pigment containing metal includes more than one pigment, each pigment having a different metal or the same metal in a different concentration.

10. A toner composition containing a predetermined metal content, comprising:

(a) at least one pigment or dye containing metal; and (b) at least one metal-free pigment or dye dispersed together in a proportion to provide a toner with developer properties and said metal content below a prescribed level, said toner composition formed by a method comprising:

(i) determining a percentage of at least one pigment or dye containing metal in a toner composition according to a prescribed level of metal content in said toner;

(ii) determining a percentage of said at least one metal-free pigment or dye in said toner according to a total percentage of pigment or dye required to provide sufficient coloration with respect to said percentage of said at least one pigment or dye containing metal; and (iii) selecting said proportions according to the percentage of said at least one metal-free pigment or dye.

11. The composition of claim 10, wherein said at least one metal-free pigment is selected from the group consisting of Heliogen Blue D-7560, Sudan Blue 670, Basonyl red 560, Hostaperm pink EB, Sudan Red 380, BASF Paliogen Red L3870HD, and Paliogen Blue L6482.

12. The compositions according to claim 10, wherein said metal-free dye is Thermoplast blue dye.

13. The composition of claim 10, wherein said at least one pigment comprising metal is selected from the group consisting of Heliogen Blue K7090, Fanal pink D4830 and Lithol Scarlet D3700.

14. The composition of claim 10, wherein said composition comprises a combination of pigments or dyes selected from the group consisting of (1) Heliogen Blue K7090 and Heliogen Blue D-7560, (2) Heliogen Blue K7090 and Sudan Blue 670, (3) Fanal pink D4830 and Basonyl red 560, (4) Fanal pink D4830 and Hostaperm pink EB, (5) Lithol Scarlet D3700 and Sudan red 380, (6) Lithol Scarlet D3700 and Paliogen red L3870HD, (7) Heliogen Blue K7090 and Thermoplast blue 684 and (8) Heliogen Blue K7090 and Paliogen Blue L6482.

15. The composition of claim 10, wherein said at least one metal-free pigment or dye is present in an amount of less than 25% by weight relative to said at least one pigment or dye containing metal.

16. A method of forming a toner composition comprising a predetermined content of a regulated material, comprising:

(a) determining a first target percentage of at least one pigment containing regulated material in a toner composition according to a prescribed level of regulated material content in said toner;

(b) determining a second target percentage of at least one pigment without regulated material in said toner according to a total percentage of pigment required to provide sufficient coloration without allowing a percentage of said at least one pigment containing regulated material to exceed said first target percentage; and (c) dispersing said pigments together in a toner composition.

17. The method of claim 16, wherein said first target percentage of at least one pigment comprising regulated material is determined by the relationship (1):

$$X=S_1/100M \quad (1)$$

wherein X is said first target percentage of at least one pigment containing regulated material in the toner; $S_1$ is the maximum parts per million (ppm) of regulated material permitted by a hazardous waste standard; and M is a regulated material content percentage of the at least one pigment containing regulated material.

18. The method of claim 17, wherein said second target percentage of said at least one pigment without regulated material is determined by the relationship (2):

$$Y=(S_2-X)K \quad (2)$$

wherein $S_2$ is a percentage of pigment required in the toner composition to provide coloration as established by a color requirement, Y is a percentage of said at least one pigment without regulated material required to be added to the toner components to meet the requirement $S_2$, and K is the ratio of the color strength of the at least one pigment containing regulated material to the color strength of the at least one pigment without regulated material.

19. The method according to claim 16, wherein said at least one pigment comprising regulated material comprises a metal, toxic or otherwise hazardous substance and said pigment without regulated material does not comprise metal, toxic or other hazardous substance.

* * * * *

UNITED STATES PATENT AND TRADEMARK OFFICE

CERTIFICATE OF CORRECTION

PATENT NO. : 5,534,379

DATED : July 9, 1996

INVENTOR(S) : Edul N. DALAL, Sue E. BLASZAK, Robert L. GRUBER, Jacques C. BERTRAND and Roger N. CICCARELLI It is certified that error appears in the above-indentified patent and that said Letters Patent is hereby corrected as shown below:

On the cover sheet, please change Item 75
change "Robert L. Gruber" to --Robert J. Gruber--.

Signed and Sealed this

Twenty-eighth Day of January, 1997

*Attest:*

Bruce Lehman

BRUCE LEHMAN

*Attesting Officer*

*Commissioner of Patents and Trademarks*